US010468827B2

(12) United States Patent
Chen

(10) Patent No.: US 10,468,827 B2
(45) Date of Patent: Nov. 5, 2019

(54) ELECTRICAL CONNECTOR HAVING AN IMPROVED ISOLATION BLOCK

(71) Applicant: FOXCONN INTERCONNECT TECHNOLOGY LIMITED, Grand Cayman (KY)

(72) Inventor: Chin-Yu Chen, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/140,557

(22) Filed: Sep. 25, 2018

(65) Prior Publication Data

US 2019/0097360 A1 Mar. 28, 2019

(30) Foreign Application Priority Data

Sep. 25, 2017 (CN) ..... 2017 2 1235710 U

(51) Int. Cl.

| | |
|---|---|
| ***H01R 13/6585*** | (2011.01) |
| ***H01R 12/71*** | (2011.01) |
| ***H01R 12/70*** | (2011.01) |
| ***H01R 12/57*** | (2011.01) |
| ***H01R 4/02*** | (2006.01) |
| ***H01R 13/6594*** | (2011.01) |
| *H01R 24/60* | (2011.01) |
| *H01R 107/00* | (2006.01) |

(52) U.S. Cl.

CPC ..... *H01R 13/6585* (2013.01); *H01R 4/02* (2013.01); *H01R 4/028* (2013.01); *H01R 12/57* (2013.01); *H01R 12/707* (2013.01); *H01R 12/716* (2013.01); *H01R 13/6594* (2013.01); *H01R 24/60* (2013.01); *H01R 2107/00* (2013.01)

(58) Field of Classification Search

CPC ..... H01R 13/6585; H01R 13/6594; H01R 12/57; H01R 12/707; H01R 12/716; H01R 24/60; H01R 4/02; H01R 4/028

USPC ..... 439/607.05, 65, 74, 80, 81, 82, 84, 92

See application file for complete search history.

(56) References Cited

U.S. PATENT DOCUMENTS 5,915,976 A * 6/1999 McHugh ..... H01R 13/6582 439/74
6,095,824 A * 8/2000 McHugh ..... H01R 23/6873 439/108

(Continued)

FOREIGN PATENT DOCUMENTS

CN 2882007 3/2007
CN 201060978 5/2008

(Continued)

*Primary Examiner* — Harshad C Patel

(74) *Attorney, Agent, or Firm* — Wei Te Chung; Ming Chieh Chang

(57) ABSTRACT

An electrical connector for soldering to a printed circuit board includes an insulative housing, a number of conductive terminals affixed to the insulative housing, and a metal shell surrounding the base portion. The insulative housing includes a base portion. Each conductive terminal includes a soldering portion extending laterally and outwardly from a lateral edge of the base portion. The metal shell includes a pair of longitudinal wall. The electrical connector includes an isolation block isolating the soldering portion from the longitudinal wall of the metal shell in a vertical direction.

11 Claims, 9 Drawing Sheets

(56) References Cited

U.S. PATENT DOCUMENTS

| | | | | |
|---|---|---|---|---|
| 6,485,328 | B1 * | 11/2002 | Wu | H01R 13/658 439/567 |
| 6,672,887 | B1 * | 1/2004 | Yu | H01R 13/6582 439/108 |
| 6,910,921 | B2 * | 6/2005 | Pan | H01R 23/688 439/108 |
| 7,086,881 | B2 * | 8/2006 | Fan | H01R 13/5213 439/142 |
| 7,108,554 | B2 * | 9/2006 | Huang | H01R 23/6873 439/378 |
| 7,144,277 | B2 * | 12/2006 | Pan | H01R 12/716 439/660 |
| 7,168,986 | B1 | 1/2007 | Peng | |
| 7,578,701 | B2 * | 8/2009 | Hsu | H01R 13/6594 439/607.34 |
| 7,717,719 | B2 * | 5/2010 | Miyazaki | H01R 12/57 439/74 |
| 9,450,340 | B2 | 9/2016 | Uratani | |
| 2005/0282437 | A1 * | 12/2005 | Fan | H01R 13/4538 439/607.05 |
| 2017/0033505 | A1 | 2/2017 | Ozeki | |
| 2018/0175561 | A1 * | 6/2018 | Chen | H01R 12/707 |

FOREIGN PATENT DOCUMENTS

| | | |
|---|---|---|
| CN | 206558802 | 10/2017 |
| TW | M435072 | 8/2012 |
| TW | 201607179 | 2/2016 |
| TW | M539713 | 4/2017 |

* cited by examiner

ELECTRICAL CONNECTOR HAVING AN IMPROVED ISOLATION BLOCK

BACKGROUND OF THE DISCLOSURE

1. Field of the Disclosure

The present disclosure relates to an electrical connector, and more particularly to an electrical connector which can avoid short circuit caused by contacting between a soldering pin of a metal shell and a soldering portion of a conductive terminal.

2. Description of Related Arts

Taiwan Utility Model M539713 discloses an electrical connector assembly including a male end connector and a female end connector structurally modified to design a joint structure to ensure effective engagement of the male end connector with the female end connector. Due to the design of the joint structure, the male end connector and the female end connector can be effectively joined when the contact area is insufficient so that the joint height between the male end connector and the female end connector can be reduced and applicable to all kinds of small electronic devices. The metal shell of the board-to-board connector is directly sleeved on the insulative housing. The side wall of the metal shell is close to the soldering portion of the conductive terminal extending outwardly from the side edge of the insulating housing, not isolated from each other such that there is risk of short circuiting when the two are in contact.

An improved electrical connector is desired.

SUMMARY OF THE DISCLOSURE

Accordingly, an object of the present disclosure is to provide an electrical connector which can avoid short circuit caused by contacting between a soldering pin of a metal shell and a soldering portion of a conductive terminal To achieve the above object, an electrical connector soldered to a printed circuit board includes an insulative housing, a number of conductive terminals affixed to the insulative housing, and a metal shell surrounding the base portion. The insulative housing includes a base portion. Each conductive terminal includes a soldering portion extending laterally and outwardly from a lateral edge of the base portion. The metal shell includes a pair of longitudinal wall. The electrical connector includes an isolation block isolating the soldering portion from the longitudinal wall of the metal shell in a vertical direction. An isolation block is provided between the metal shell and the soldering portion of the conductive terminals protruding outwardly from the insulative housing, thereby isolating the longitudinal wall of the metal shell from the soldering portion of the conductive terminal to prevent short circuit.

Other objects, advantages and novel features of the disclosure will become more apparent from the following detailed description when taken in conjunction with the accompanying drawings.

DETAILED DESCRIPTION OF THE PREFERRED EMBODIMENT

Reference will now be made in detail to the embodiments of the present disclosure. The direction of the conductive terminals arranged is a lengthwise direction.

Referring to FIGS. 1-3 and 8-9, a first electrical connector 100 is shown for soldering on a printed circuit board and a second electrical connector 200 is shown for soldering on another printed circuit board. The first electrical connector 100 is mated with the second electrical connector 200.

Figure 4:
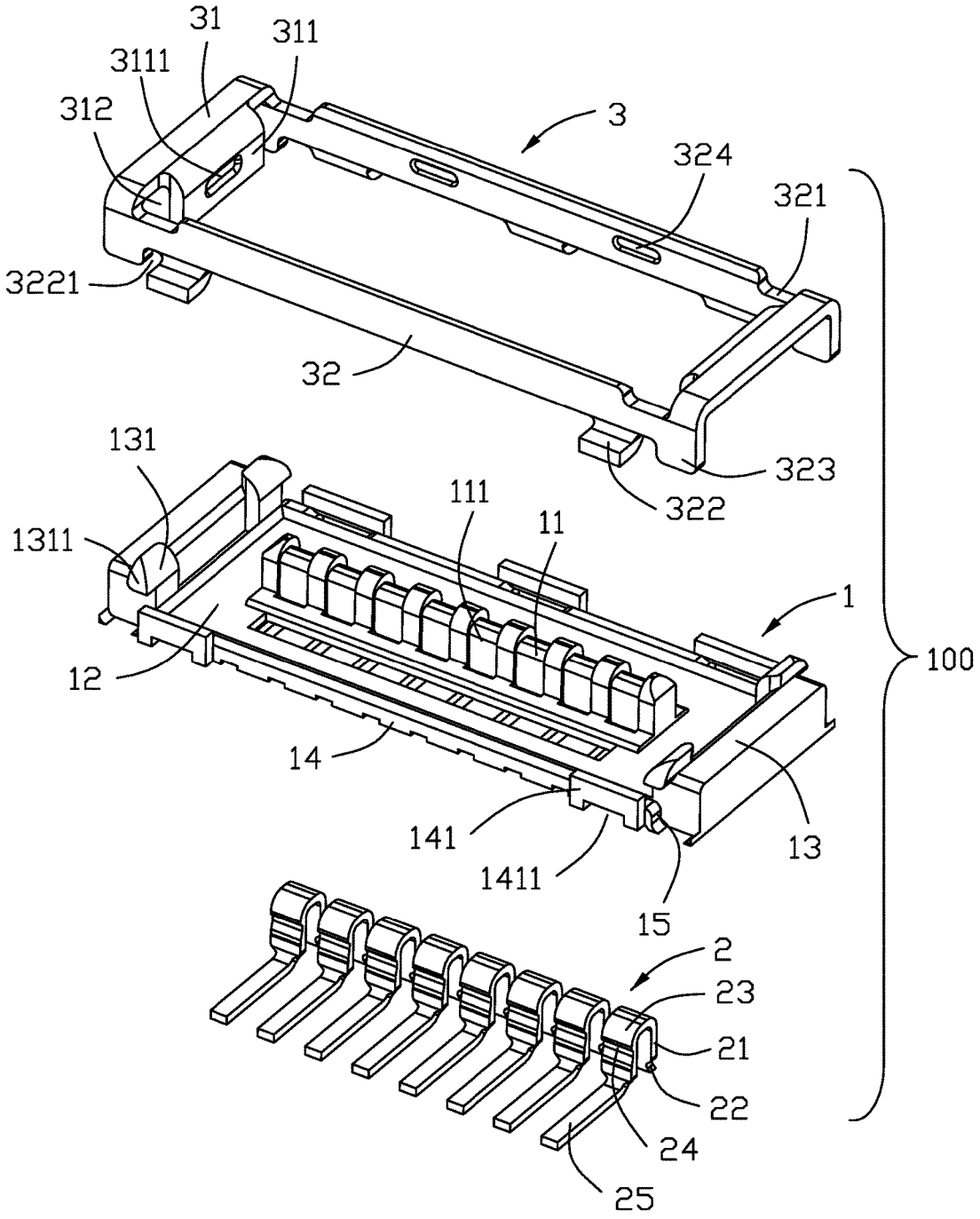
FIG. 4 is an exploded view of the first electrical connector.
Figure 5:
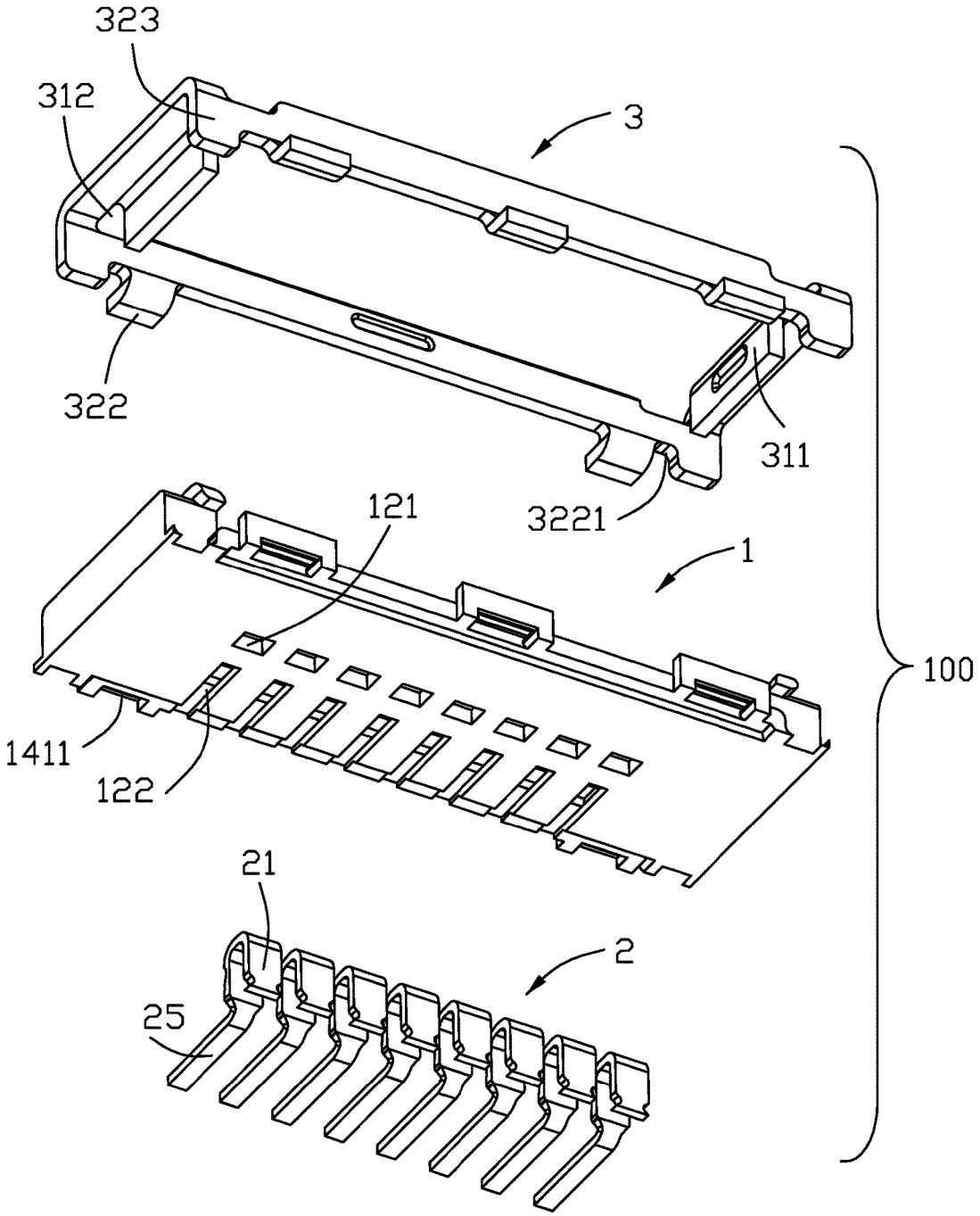
FIG. 5 is another exploded view of the first electrical connector taken from FIG. 4.
Figure 6:
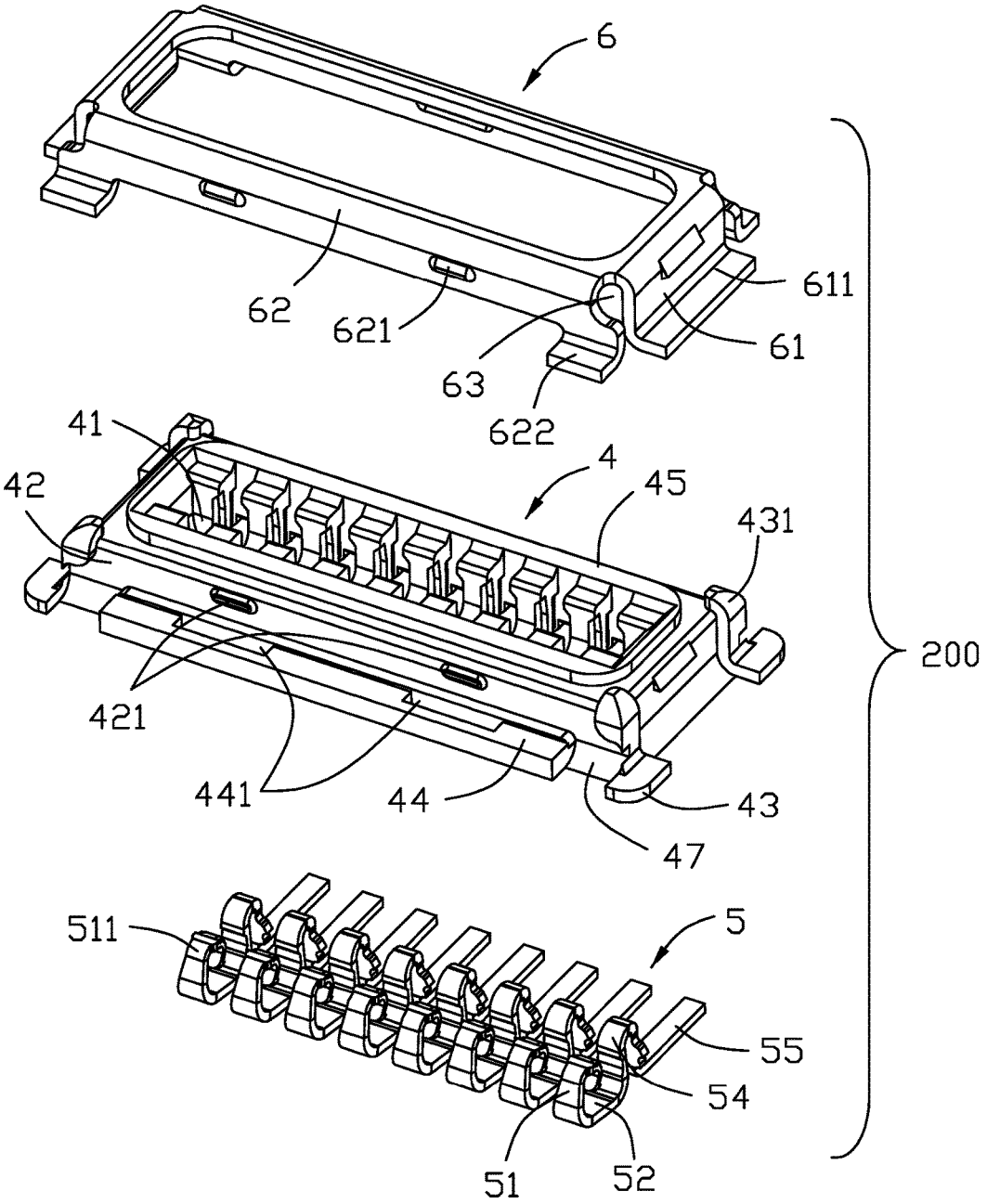
FIG. 6 is an exploded view of the second electrical connector.
Figure 7:
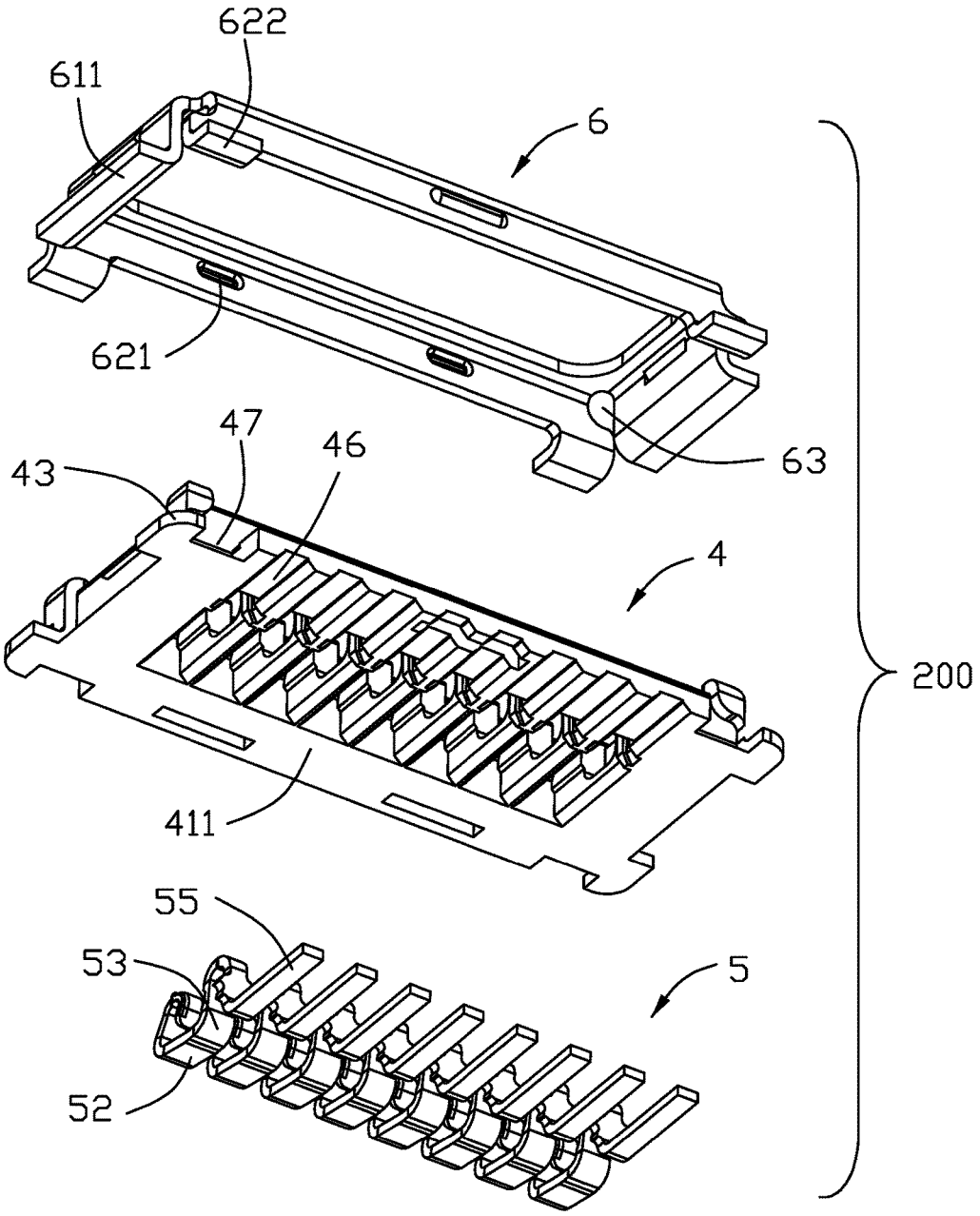
FIG. 7 is another exploded view of the second electrical connector taken from FIG. 6.
Figure 8:
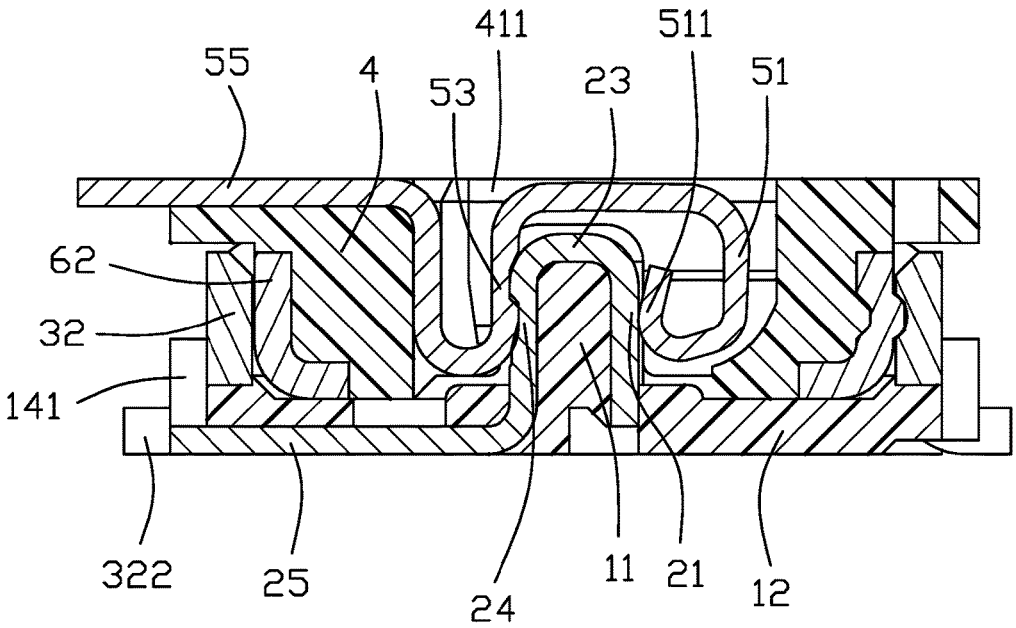
FIG. 8 is a cross-sectional view of the first electrical connector and the second electrical connector taken along line 8-8 in FIG. 1.
Figure 9:
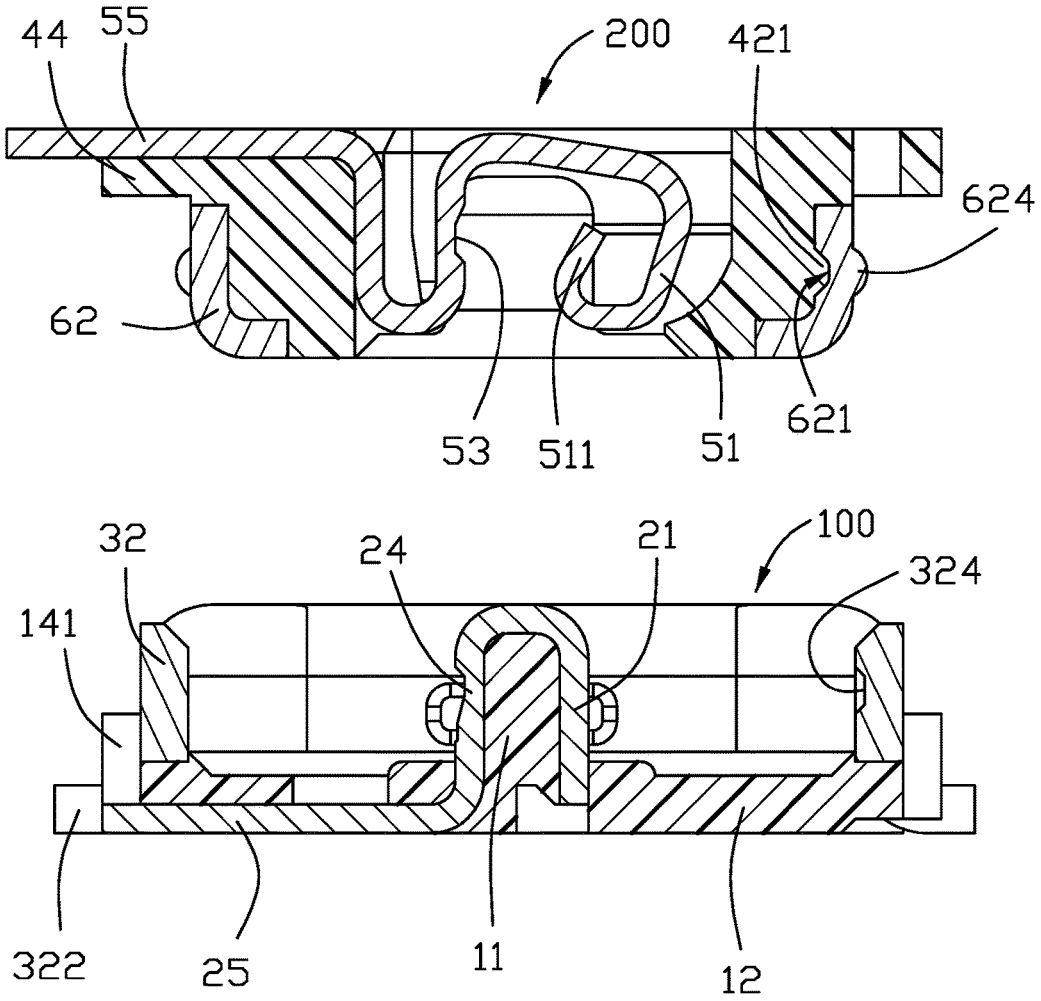
FIG. 9 is a cross-sectional view of the first electrical connector and the second electrical connector taken along line 9-9 in FIG. 2.

Referring to FIGS. 4 to 5, the first electrical connector 100 includes a first insulative housing 1, a number of first conductive terminals 2 affixed to the first insulative housing 1, and a first metal shell 3 enclosing the first insulative housing 1.

Referring to FIGS. 4-5 and 8-9, the first insulative housing 1 includes a first base portion 12, a tongue portion 11 extending upwardly from the first base portion 12, a pair of end portions 13 isolated from each other in the lengthwise direction, and a first isolation block 14 located between the pair of the end portions 13. The first electrical connector 100 includes an annular slot 10 formed between the tongue portion 11 and the first metal shell 3 for insertion of the second electrical connector 200. The tongue portion 11 protrudes upwardly from the base portion 12 into the annular slot 10 and has a convex rib shape. The tongue portion 11 includes a number of terminal grooves 111 isolated from each other in the lengthwise direction. The first base portion 12 includes a number of through holes 121 and recesses 122 located laterally of the tongue portion 11 and corresponding to the terminal grooves 111. The through holes 121 and the recesses 122 are used for receiving the first conductive terminals 2. The end portions 13 include a pair of buckling portion 131 in a transverse/lateral direction perpendicular to the lengthwise direction isolated from each other and protruding into the annular slot 10 in the lengthwise direction, and a pair of barriers 1311 protruding laterally from the end portions 13 in the transverse direction and located outside of the buckling portions 131. The buckling portions 131 protrude outwardly from the end portions 13 in the lengthwise direction and protrude into the annular slot 10. The first isolation block 14 isolates a first wall 32 of the first metal shell 3 from a first soldering portions 25 of the first conductive terminals 2 in a vertical direction perpendicular to the lengthwise direction and the transverse direction preventing contacting of the first metal shell 3 and the first conductive terminals 2. The first insulative housing 11 includes an insulator 141 located at two ends of the first isolation block 14 in the lengthwise direction. The insulator 141 includes a number of positioning holes 1411. The insulator 141 is located at an edge of the first base portion 12 in the lengthwise direction. The first insulative housing 1 further includes a pointed-shaped resisting portion 15 projecting in the lengthwise direction of the front end or the rear end of the insulating insulator 141.

The first conductive terminals 2 are affixed to the terminal grooves 111. Each conductive terminal 2 includes a first contacting portion 21, a fixed portion 22 extending laterally from a bottom of the first contacting portion 21 and going through the through hole 121 to be affixed to the first insulative housing 1, a second contacting portion 24 disposed in symmetry with the first contacting portion 21 and isolated from the first contacting portion 21, an arched connecting portion 23 connecting the first contacting portion 21 and the second connecting portion 24, and the first soldering portion 25 extending laterally from a bottom of the second contacting portion 24 and going through the first base portion 12 to be affixed to the recess 122. The first contacting portion 21, the second contacting portion 24, and the arched connecting portion 23 are affixed to the terminal grooves 111 and exposed to the annular slot 10. The first soldering portions 25 extend laterally from the edge of the first base portion 12, and are arranged in a row in the lengthwise direction.

The first metal shell 3 includes a pair of covering portions 31 covering the end portions 13 and a pair of first longitudinal walls 32 connecting the pair of covering portions 32. The covering portions 31 include a pair of abutting portions 311 bending downwardly into the annular slot 10 and latched between the pair of buckling portions 131. Each abutting portion 311 includes an abutting hole 3111. The first metal shell 3 includes two pairs of locating gaps 312 located between the abutting portions 311 and the first longitudinal walls 32 and buckled with the buckling portions 131. The first metal shell 3 further includes a pair of locating recesses 321 recessed in an upper portion of the first longitudinal walls 32 near the locating gaps 312. The first longitudinal wall 32 further includes a pair of fixed pins 323 bending downwardly from a front end or an rear end of the locating recess 321, a pair of soldering pins 322 extending laterally from a bottom of the locating recess 321 and isolating the fixed pins 323, and a resisting gap 3221 located between the soldering pin 322 and the fixed pin 323. The barrier 1311 is erected on the locating recess 321 for fixing the first metal shell 3 and the first insulative housing 1. The soldering pin 322 is fixedly disposed through the positioning hole 1411. The soldering pin 322 extends outwardly from the bottom of the first longitudinal wall 32 in the transverse direction, and is isolated from the first soldering portion 25 of the first conductive terminal 2 by the insulator 141. The insulator 141 covers an upper portion and two lateral sides of the soldering pin 322. The resisting gap 3221 receives the resisting portion 15.

Figure 1:
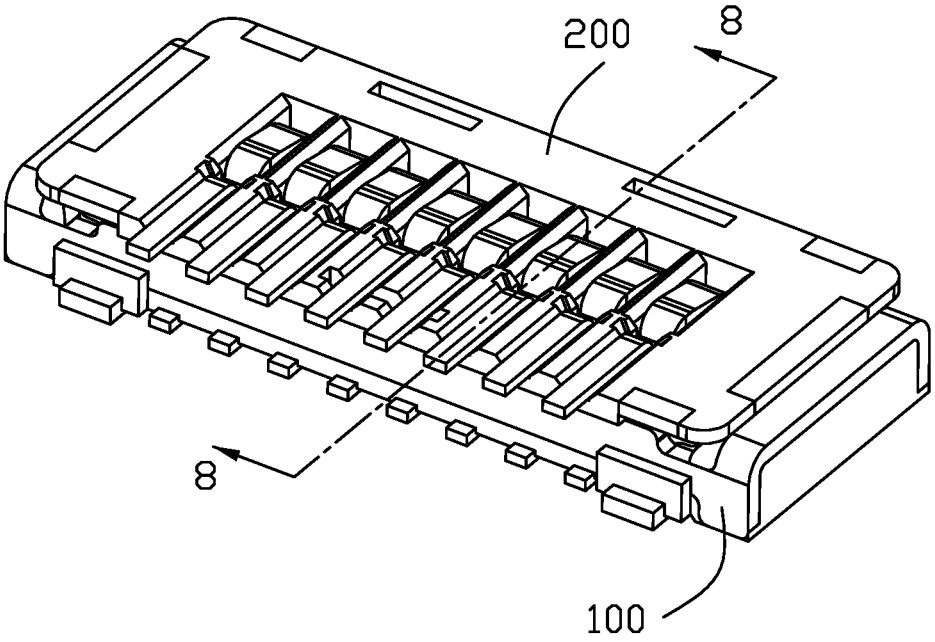
FIG. 1 is a perspective, assembled view of a first electrical connector mated with a second electrical connector.
Figure 2:
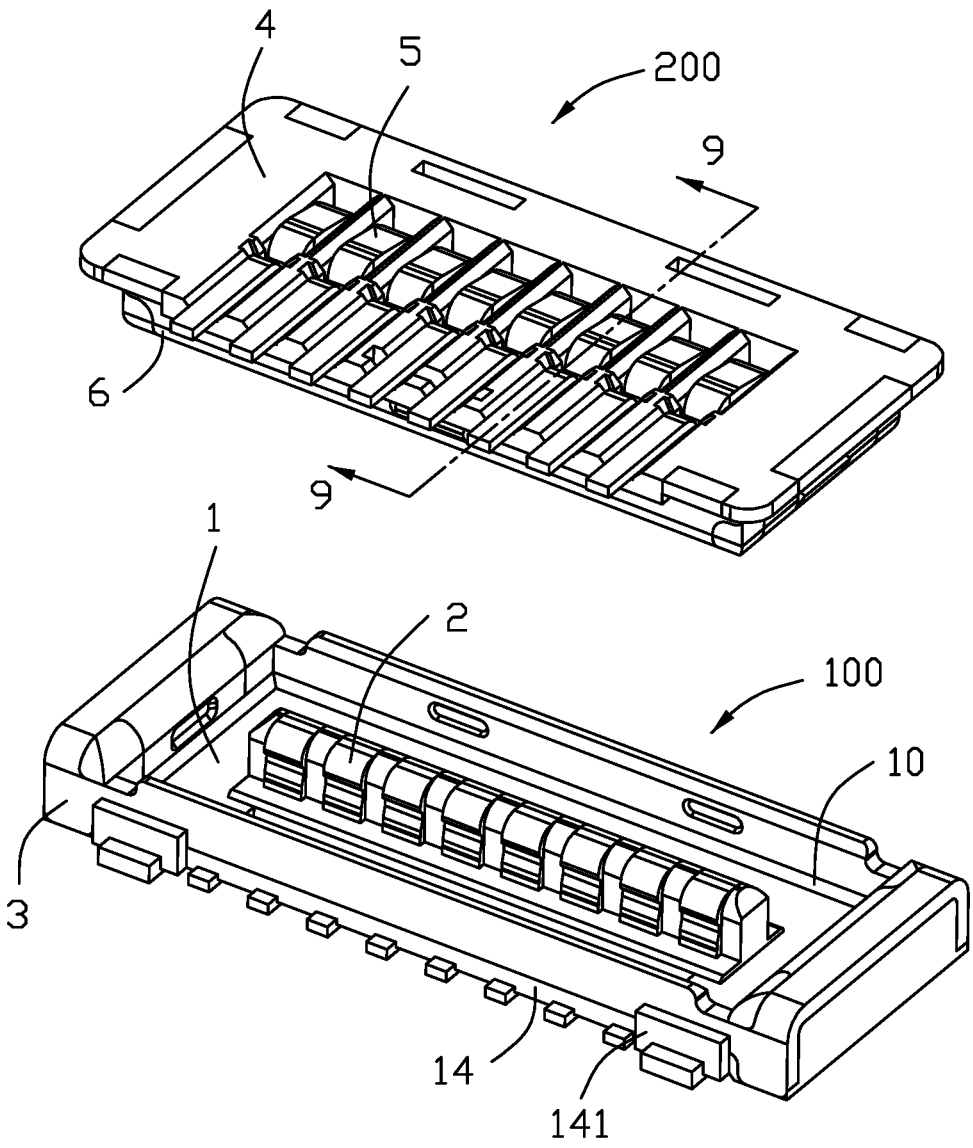
FIG. 2 is a perspective, assembled view of the first electrical connector not mated with the second electrical connector.
Figure 3:
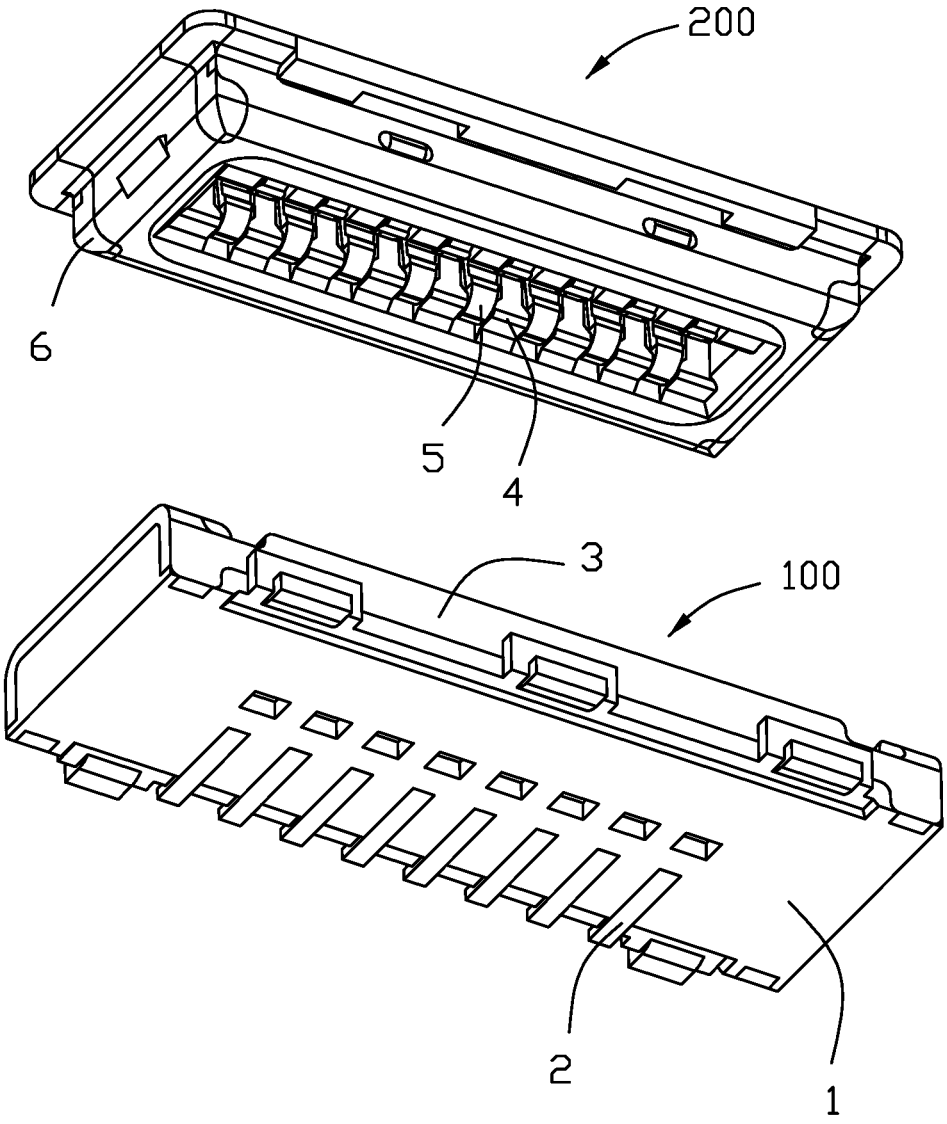
FIG. 3 is another assembled view of the first electrical connector and the second electrical connector taken from FIG. 2.

Referring to FIGS. 2 and 4-5, the first metal shell 3 is integrally molded with the first insulative housing 1. After the first electrical connector 100 is assembled, the first longitudinal wall 32 and the covering portion 31 are continuously disposed outside of the first insulative housing 1 to have a good shielding effect. The first soldering portion 25 of the first conductive terminal 2 protrudes outside of the end portion 13. The soldering pin 322 of the first metal shell 3 passes through the positioning hole 1411 and protrudes laterally from the first longitudinal wall 32. The insulator 141 isolates the first soldering portion 25 from the soldering pin 322 to prevent short-circuiting between the two, and protect the first electrical connector 100.

Referring to FIGS. 2-3 and 6-9, the second electrical connector 200 includes a second insulative housing 4, a number of second conductive terminals 5 affixed to the second insulative housing 4, and a second metal shell 6 disposed outside of the second insulative housing 4. The second insulative housing 4 includes a central slot 41 recessed in a top surface thereof and disposed in the lengthwise direction, an annular wall 42 disposed at a periphery of the central slot 41, four fixed parts 43 extending outwardly from four corners of the annular wall 42, a second isolation block 44 extending horizontally outwardly from two sides of the annular wall 42 in the transverse direction, and a lap 45 on both sides of the top surface of the central slot 41, a number of terminal channels 46 for receiving the second conductive terminals 5, and a notch 47 located between the second isolation block 44 and the fixed part 43. The bottom surface of the central slot 41 is a second base portion 411. A pair of protuberances 421 are respectively protruded from two sides of the annular wall 42. The upper end of the fixing part 43 is provided with a bracket 431 with protruding outwardly from the surface thereof. The terminal channel 46 extends from the inside of the central slot 41 to the outside of the bottom of the second insulative housing 4.

Each second conductive terminal 5 includes a first mating portion 51, a second mating portion 53 opposite to the first mating portion 51, a horizontal connecting portion 52 connecting the first mating portion 51 and the second mating portion 53, a U-shaped connecting portion 54 extending upwardly from a free end of the second mating portion 53 and then bending downwardly, and a second soldering portion 55 extending laterally from a free end of the U-shaped connecting portion 54. The first mating portion 51 includes a hook 511 extending upwardly and then bending downwardly from a free end of the first mating portion 51. The first mating portion 51, the second mating portion 53 and the horizontal connecting portion 52 are affixed to the terminal channel 46. The hook 511 and the second mating portion 53 are exposed to the central slot 41 to contact with the first conductive terminals 2.

The second metal shell 6 includes a pair of end portions 61 in the lengthwise direction, a pair of second longitudinal walls 62 connecting the pair of end portions 61, and four fixed openings 63 recessed between the end portions 61 and the second longitudinal walls 62. The end portion 61 includes a first soldering part 611 extending in the lengthwise direction. The second longitudinal wall 62 includes a pair of second soldering parts 622 extending laterally and a pair of receiving recesses 621 located at the surface of the second longitudinal wall 62 and receiving protuberances 421. On the other hand, a pair of protrusions 624 are formed opposite to the corresponding recesses 621 and received within the recessions 324 of the longitudinal wall 32 during mating. In this embodiment, the second insulation block 44 forms a pair of through holes 441 corresponding to the pair of protrusions 624 for molding consideration.

In assembling the second electrical connector 200, firstly the second conductive terminals 5 are affixed to the second insulative housing 4. The second conductive terminals 5 are affixed to the terminal channel 46. The second soldering portion 55 extends outwardly from the terminal channel 46 and is exposed to an out edge of the second base portion 411. Secondly the second metal shell 6 and the second insulative housing 4 are integrally molded with each other. The protuberances 421 are received in the receiving recesses 621. The bracket 431 is locked in the fixed opening 63. The notch 47 receives the second soldering part 622. The second soldering part 622 is isolated from the second soldering portion 55 by the notch 47. The second isolation block 44 isolates the second soldering portion 55 from the second longitudinal wall 62 in the vertical direction.

When the first electrical connector 100 is mated with the second electrical connector 200, the annular wall 42 plugs in the annular slot 10. The tongue portion 11 inserts the central slot 41. The second longitudinal wall 62 of the second metal shell 6 resists against the first base portion 12 and contacts with the first longitudinal wall 32 in the transverse direction strengthening the effect of shielding. The hook contacts with the first contacting portion 21. The second mating portion 53 contacts with the second contacting portion 24.

Compared with the prior art, the first metal shell 3, which is of a seamless frame structure, is continuously and uninterruptedly disposed on the periphery of the first insulative housing 1 of the first electrical connector, and the second metal shell 6, which is of another frame structure, is continuously and uninterruptedly disposed on the periphery of the second insulative housing 4 of the second electrical connector to achieve the shielding effect. The insulator 141 is disposed between the soldering pin 322 of the first metal shell and the first soldering portion 25 of the first conductive terminal 2 in the lengthwise direction avoiding short circuits. The second soldering part 622 of the second metal shell 6 is locked in the notch 47 and is isolated from the second soldering portion 55 of the second conductive terminal 5 in the lengthwise direction to prevent short circuit.

The first insulative housing 1 and the second insulative housing 2 constitute an overall insulative housing. The horizontal connecting portion 52 and the U-shaped connecting portion 54 constitute an overall connecting portion.

While the preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector for soldering to a printed circuit board, comprising:

an insulative housing comprising a base portion;

a plurality of conductive terminals affixed to the insulative housing and each comprising a soldering portion extending laterally and outwardly from a lateral edge of the base portion; and a metal shell surrounding the base portion and comprising a pair of longitudinal wall; wherein the electrical connector comprises an isolation block isolating the soldering portion from the longitudinal wall of the metal shell in a vertical direction, wherein the conductive terminals are arranged in a lengthwise direction perpendicular to the vertical direction, the longitudinal wall of the metal shell comprises a soldering pin located beside the soldering portion, and the insulative housing comprises an insulator isolating the soldering pin from the soldering portion in the lengthwise direction, further comprising an annular slot, and wherein the insulative housing comprises a tongue portion extending upwardly from the base portion, the annular slot located between the tongue portion and the metal shell, wherein the metal shell comprises a pair of covering portions in the lengthwise direction and the pair of longitudinal walls connecting the pair of covering portions, the insulative housing comprises a pair of end portions in the lengthwise direction covered by the covering portions, and the insulator is located at an edge of the base portion in the lengthwise direction and comprises a plurality of positioning holes for insertion of the soldering pins, and wherein the metal shell comprises an abutting portion bending downwardly from the covering portion to the annular slot, a locating gap formed between the longitudinal wall and the covering portion, and a pair of locating recesses recessed in an upper portion of the locating gap near the longitudinal wall, the end portion comprises a pair of buckling portions going upwardly and through the locating gaps, and the buckling portion comprises a barrier erected on the locating recess.

2. The electrical connector as claimed in claim 1, wherein the metal shell is integrally molded with the insulative housing.

3. The electrical connector as claimed in claim 1, wherein the insulator covers an upper side and two lateral sides of the soldering pin.

4. The electrical connector as claimed in claim 1, wherein each conductive terminal comprises a contacting portion affixed to the tongue portion and exposed to the tongue portion, and the soldering portion extends laterally from a bottom of the contacting portion and outwardly from the lateral edge of the longitudinal wall.

5. The electrical connector as claimed in claim 1, wherein the insulative housing includes an annular wall extending upwardly from the base portion to define a central slot, each conductive terminal comprises a connecting portion affixed to the annular wall, a contacting portion protruding into the central slot, and the soldering portion, and the metal shell is disposed outside the annular wall.

6. The electrical connector as claimed in claim 5, wherein four corners of the annular wall project outwardly to form four fixed parts, a notch is formed between the isolation block and the fixed part, the longitudinal wall of the metal shell comprises a second soldering part located beside the soldering portion in the lengthwise direction, and the second soldering parts are recessed in the notches and isolated from the soldering portion in the lengthwise direction.

7. An electrical connector assembly comprising:

a first electrical connector including:

a first insulative housing including a first base portion and a tongue portion extending upwardly from the base portion, a pair of first isolation blocks extending along a lengthwise direction and located on two opposite lateral sides of the first base portion, respectively, in a lateral direction perpendicular to said lengthwise direction;

at least one row of first terminals insert-molded within the first insulative housing with corresponding first contacting portions exposed upon the tongue portion and corresponding first soldering portions extending outward in said lateral direction under the corresponding isolation blocks in a vertical direction perpendicular to both the lengthwise direction and the lateral direction;

a first metallic shell insert-molded with the first insulative housing and defining a first frame structure with a pair of first longitudinal walls extending along the lengthwise direction, directly facing the tongue portion in the lateral direction, and positioned upon the corresponding first isolation blocks so as to be spaced from the first soldering sections of the corresponding first terminals in the vertical direction, a second electrical connector adapted to be mated with the first electrical connector, wherein said second electrical connector includes a second insulative housing with a second base portion with an annular wall surrounding a central slot which receives the tongue portion during mating, a pair of second isolation blocks each extending along the lengthwise direction and commonly extending outwardly from the annular wall in the lateral direction away from each other, at least one row of second terminals insert-molded within the second insulative housing with corresponding second contacting sections exposed in the central slot and corresponding second soldering sections extending outwardly beyond the annular wall in the lateral direction, a second metallic shell insert-molded with the second insulative housing and including a pair of second longitudinal walls, and each second longitudinal wall being spaced from the corresponding second soldering sections by the corresponding second isolation block in the vertical direction, wherein during mating, the first longitudinal wall is intimately located outside of the corresponding second longitudinal wall in the lateral direction and spaced from the corresponding second soldering sections by said second isolation block in the vertical direction, wherein one second longitudinal wall forms a pair of protrusions to be engaged within corresponding recessions in the corresponding first longitudinal wall, and the corresponding second insulation block forms a pair of through holes aligned with the corresponding protuberances, respectively, in the vertical direction for molding consideration.

8. The electrical connector assembly as claimed in claim 7, wherein the first insulative housing further includes on each lateral side a pair of insulators each surrounding a first soldering pin of the corresponding first longitudinal wall and located on an outer side of the corresponding first longitudinal wall in the lateral direction and isolating the first soldering pin from the first soldering portion of the neighboring first terminal.

9. The electrical connector assembly as claimed in claim 7, wherein the first housing forms a pair of end portions at two opposite ends in the lengthwise direction, and the first metallic shell includes a pair of covering portions shielding the pair of end portions in the vertical direction and connecting the pair of first longitudinal walls.

10. An electrical connector comprising:

an insulative housing with a base portion with an annular wall surrounding a central slot, a pair of isolation blocks each extending along a lengthwise direction and commonly extending outwardly from the annular wall away from each other in a lateral direction perpendicular to the lengthwise direction;

at least one row of terminals insert-molded within the insulative housing with corresponding contacting sections exposed in the central slot and corresponding soldering sections extending outwardly beyond the annular wall in the lateral direction, a metallic shell insert-molded with the insulative housing and including a pair of longitudinal walls, and each longitudinal wall being spaced from the corresponding soldering sections by the corresponding isolation block in a vertical direction perpendicular to both the lengthwise direction and the lateral direction, one longitudinal wall forms a pair of protrusions, and the corresponding isolation block forms a pair of through holes aligned with the pair of protrusions in the vertical direction for molding consideration, and wherein a pair of recesses are formed in the corresponding longitudinal wall opposite to said pair of protrusions in the lateral direction to receive therein a pair of protuberances on the annular wall.

11. The electrical connector as claimed in claim 10, wherein said isolation block extends outwardly in the lateral direction behind the corresponding longitudinal wall to confront another longitudinal wall of another metallic shell of a complementary mating connector in the vertical direction during mating.

* * * * *